US008979604B1

(12) United States Patent
Woolley

(10) Patent No.: US 8,979,604 B1
(45) Date of Patent: Mar. 17, 2015

(54) FLYING SKI AND ELONGATED BOARD FOR FLYING SKI

(76) Inventor: Robert C. Woolley, Lake Havasu City, AZ (US)

( * ) Notice: Subject to any disclaimer, the term of this patent is extended or adjusted under 35 U.S.C. 154(b) by 438 days.

(21) Appl. No.: 13/335,573

(22) Filed: Dec. 22, 2011

Related U.S. Application Data

(60) Provisional application No. 61/506,882, filed on Jul. 12, 2011.

(51) Int. Cl.
*B63B 1/26* (2006.01)
*B63B 35/81* (2006.01)
*B63B 35/79* (2006.01)

(52) U.S. Cl.
CPC ..... *B63B 35/7906* (2013.01)
USPC ..... 441/72; 114/253; 114/274; 114/357

(58) Field of Classification Search
CPC B63B 35/79; B63B 35/7906; B63B 35/7909; B63B 35/7923; B63B 35/7926; B63B 35/793; B63B 35/81; B63B 2035/79; B63B 2035/7903; B63B 2231/50; B63B 2231/52; B63B 1/24; B63B 1/26
USPC ..... 114/253, 274, 357; 441/65, 68, 72, 74, 441/79
See application file for complete search history.

(56) References Cited

U.S. PATENT DOCUMENTS

| | | | |
|---|---|---|---|
| 2,257,406 | A | 9/1941 | Von Burtenbach |
| 2,597,048 | A | 5/1952 | Almqvust et al. |
| 2,751,612 | A | 6/1956 | Shepard |
| 2,930,338 | A | 3/1960 | Flomenhoft |
| 2,931,332 | A | 4/1960 | Hebrank |
| 2,955,559 | A | 8/1961 | Palmer et al. |
| 3,003,778 | A | 10/1961 | Taggart |
| 3,026,546 | A | 3/1962 | Kakes |
| 3,085,537 | A | 4/1963 | Headrick et al. |
| 3,092,857 | A | 6/1963 | Churchman |
| 3,092,858 | A | 6/1963 | Wallach |
| 3,105,249 | A | 10/1963 | Palmore |
| 3,121,890 | A | 2/1964 | Rumsey, Jr. |
| 3,123,844 | A | 3/1964 | Bailey |
| 3,145,399 | A | 8/1964 | Jackson |
| 3,164,119 | A | 1/1965 | Emmanuel et al. |
| 3,182,341 | A | 5/1965 | Rieffle |
| 3,201,807 | A | 8/1965 | Weaver |
| 3,208,422 | A | 9/1965 | Schopmeyer |
| 3,216,031 | A | 11/1965 | Ingold, Jr. |
| 3,455,264 | A | 7/1969 | Castellani |
| 3,604,031 | A | 9/1971 | Cahill |

(Continued)

FOREIGN PATENT DOCUMENTS

| | | | |
|---|---|---|---|
| AU | 652929 B2 | 8/1992 | |
| DE | 4128957 A1 * | 3/1993 | ..... B63B 5/24 |

(Continued)

*Primary Examiner* — Ajay Vasudeva
(74) *Attorney, Agent, or Firm* — Knobbe Martens Olson & Bear LLP

(57) ABSTRACT

An improved elongated board for a flying ski designed to be towed behind a conventional powered watercraft utilizing a standard ski tow rope or similar device. The elongated board comprises a front end and a back end. The front end extending from a front edge to about one-half of the length of the elongated board, the back end extending from a back edge to about one-half of the length of the elongated board, and the back end has a greater mass than the front end.

7 Claims, 6 Drawing Sheets

(56) References Cited

U.S. PATENT DOCUMENTS

| | | | | |
|---|---|---|---|---|
| 3,688,723 | A | | 9/1972 | Ulvesand et al. |
| 3,744,811 | A | | 7/1973 | Johnston |
| 3,747,138 | A | | 7/1973 | Morgan |
| 3,803,653 | A | | 4/1974 | Trostad |
| 3,996,868 | A | | 12/1976 | Schagen |
| 4,028,761 | A | | 6/1977 | Taylor |
| D265,116 | S | | 6/1982 | Churchill |
| 4,361,103 | A | | 11/1982 | Willat |
| 4,508,046 | A | | 4/1985 | Coulter et al. |
| 4,593,926 | A | | 6/1986 | Pergola |
| 4,669,992 | A | | 6/1987 | Morris |
| 4,720,280 | A | | 1/1988 | Hufnagl et al. |
| 4,857,025 | A | | 8/1989 | Brown et al. |
| 4,857,026 | A | | 8/1989 | Hull |
| 4,964,825 | A | * | 10/1990 | Paccoret et al. ..... 441/74 |
| 5,100,354 | A | | 3/1992 | Woolley et al. |
| 5,249,998 | A | * | 10/1993 | Woolley et al. ..... 441/65 |
| 6,068,531 | A | * | 5/2000 | Patterson ..... 441/74 |
| 7,097,523 | B2 | | 8/2006 | Woolley et al. |
| 2007/0218787 | A1 | * | 9/2007 | Carter et al. ..... 441/74 |
| 2012/0196079 | A1 | * | 8/2012 | Brauers et al. ..... 428/116 |

FOREIGN PATENT DOCUMENTS

| | | | | |
|---|---|---|---|---|
| EP | 224023 | A1 * | 6/1987 | ..... B63B 5/24 |
| FR | 426487 | E | 7/1911 | |
| FR | 1295926 | A | 5/1962 | |
| FR | 2787088 | A1 * | 6/2000 | ..... B63B 35/79 |

* cited by examiner

FLYING SKI AND ELONGATED BOARD FOR FLYING SKI

RELATED APPLICATION

This application claims the benefit of U.S. Provisional Application No. 61/506,882, filed Jul. 12, 2011, which is incorporated herein by reference in its entirety.

BACKGROUND OF THE INVENTION

1. Field of the Invention

This application relates to recreational water equipment and, in particular, to flying skis and methods of making flying skis.

2. Description of the Related Art

U.S. Pat. Nos. 5,100,354, 5,249,998, and 7,097,523 disclose an apparatus known as a flying ski. The flying ski is a device adapted to be towed behind a powered watercraft in a manner similar to a water ski. In contrast to a water ski, however, the rider sits on a seat spaced above the ski board and primarily rides on a blade structure that is spaced below the ski board by a vertical strut. When the ski is in use, the rider, seat and board are above the water surface and the blade structure is submerged below the water surface. The flying ski disclosed in the above-identified patents was a pioneering recreational water device.

SUMMARY OF THE INVENTION

Disclosed herein are embodiments of flying skis and elongated boards for flying skis. Certain embodiments include an elongated board configured for use with a recreational device that supports a seated human rider while the rider and the device are towed behind a powered watercraft. The elongated board can include a front end and a back end. The front end extends from a front edge to about one-half of the length of the elongated board and the back end extends from a back edge to about one-half of the length of the elongated board. The back end includes an opening configured to couple with a seat portion extending upward from a top side of the back end of the board and a strut extending downward from a bottom side of the back end of the board. The back end has a greater mass than the front end. Furthermore, a back one-third of the board may have a greater mass than a front two-thirds of the board. For example, the back one-third of the board may have a back mass per square inch surface area and the front two-thirds of the board may have a front mass per square inch surface area less than the back mass per square inch surface area.

In certain embodiments, an elongated board includes a foam core, a first fibrous layer on a top surface of the foam core, and a second fibrous layer on a bottom surface of the foam core. At least one hole can extend through the foam core and the fibrous layer. An inner surface of the at least one hole includes fibers and a resin such that the resin extends from the first fibrous layer to the second fibrous layer. The resin, the first fibrous layer, and the second fibrous layer may form a unitized structure.

DETAILED DESCRIPTION OF THE PREFERRED EMBODIMENT

Disclosed herein are embodiments of flying skis and elongated boards for flying skis. Certain embodiments of skis and boards may be disclosed in the context of the types of skis disclosed in U.S. Pat. Nos. 5,100,354, 5,249,998, and 7,097,523, each of which are incorporated by reference in their entirety herein. The principles of skis and boards described herein, however, are not limited to the types of flying ski in those disclosures. Instead, it will be understood by one of skill in the art, in light of the present disclosure, that the improved types of skis and boards disclosed herein can also be successfully utilized in connection with other types of skis, both presently known and later developed, as well as other recreational water and nonwater devices. One skilled in the art may also find additional applications for the improvements disclosed herein. However, the skis and boards described herein are particularly advantageous in connection with the types of flying ski disclosed in the incorporated patents.

Figure 1:
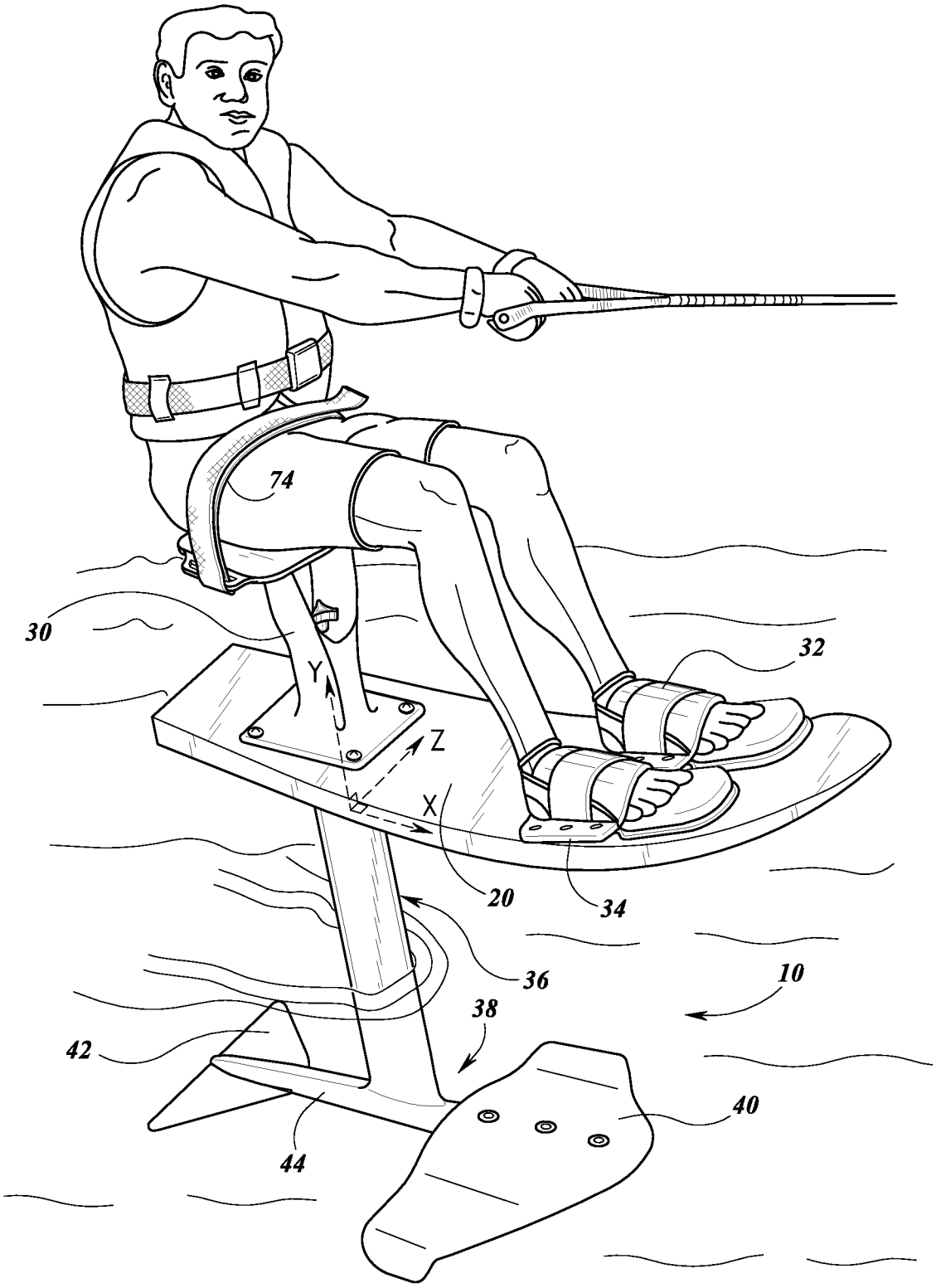
FIG. 1 is a perspective view of a flying ski in accordance with certain embodiments described herein, illustrating the general orientation of the ski when in use and supporting a seated human rider being towed behind a powered watercraft (not shown)
Figure 2:
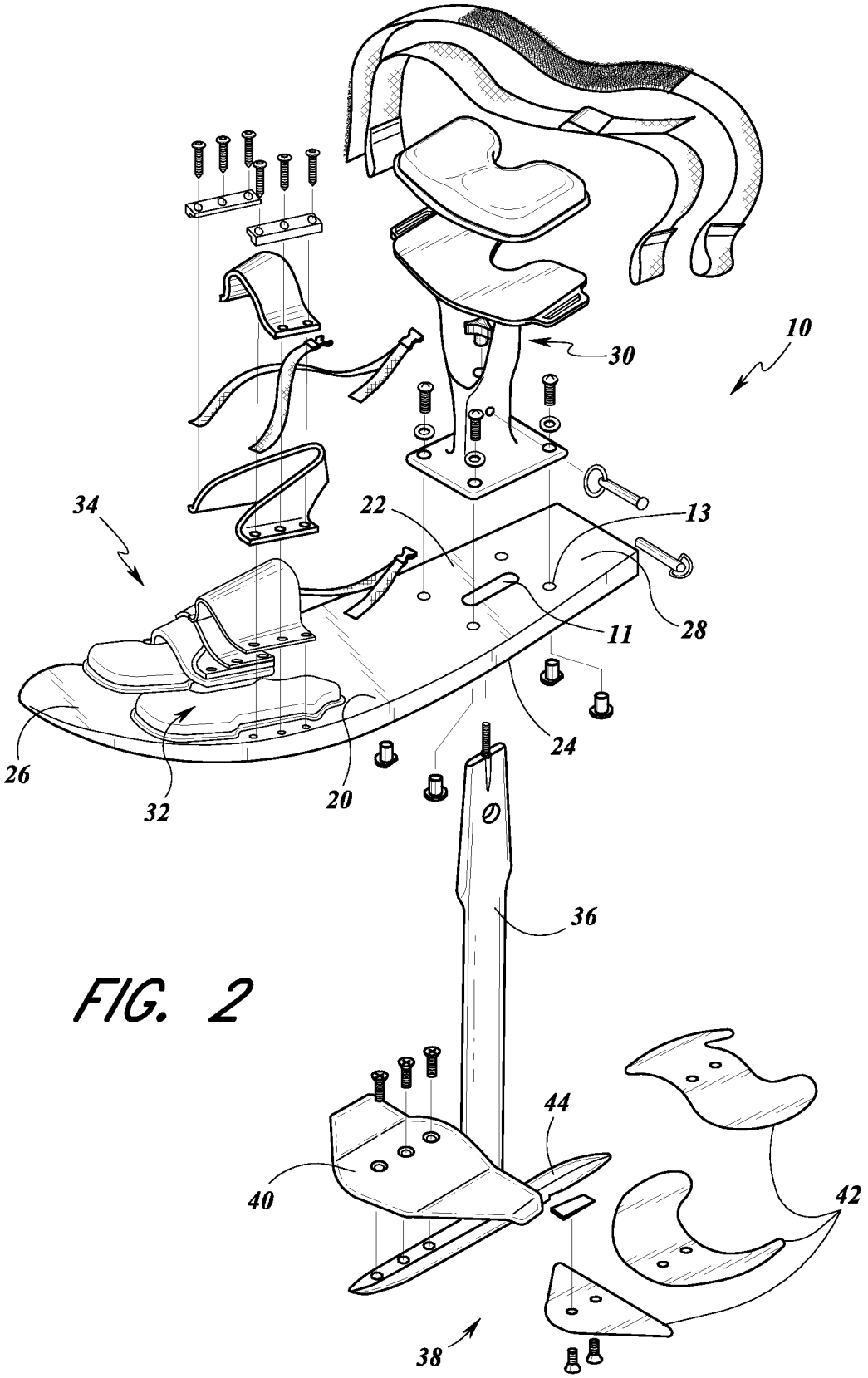
FIG. 2 is an exploded perspective view of the ski of FIG. 1, illustrating component parts of the ski.

With reference to FIGS. 1 and 2, the flying ski 10 includes an elongate board 20 having an upper face 22 and a lower face 24, and a front end 26 and a rear end 28. A seat 30 extends generally perpendicular to and upward from the upper face 22 of the board 20 to support the seated rider's buttocks. The rider's legs extend toward the front end 26 of the board 20 and are secured by a pair of foot holders 32, 34 that attach to the board 20. An elongate strut 36 extends generally perpendicular to and downward from the board 20 and couples the seat 30 to a planing blade 38. The planing blade 38 advantageously has a front blade 40 and a rear blade 42 interconnected by a fuselage 44.

With reference to FIG. 1, the improved flying ski 10 is desirably towed behind a conventional powered watercraft (not shown) utilizing a standard ski tow rope or similar device having a handle that can be held by the human rider (illustrated at a point spaced above the rider's knees for rider comfort). In use, the rider is seated on the seat of the flying ski and towed by the watercraft.

Referring to FIG. 2, the elongate board 20 is configured generally similar to the boards of the incorporated patents.

The board 20 has a longitudinal length of about 0.5 to 5 m, more preferably about 1 to 2 m and most preferably about 1.3 m. The front portion of the board is curved upward at an increasing rate toward the front end 26 of the board 20. That is, the rear end 28 of the board 20 is substantially planar in the longitudinal direction while the front end 26 has approximately one foot of rise. The lateral width of the board 20 is generally bullet shaped, with the rear end 28 width about 200 mm, a midsection width of about 300 mm, and a front end 26 nose width of about 20-40 mm.

The board 20 is preferably manufactured by compression molding. However, in other embodiments the board 20 can be manufactured through a variety of other suitable manufacturing techniques, both presently known or later developed.

The board 20 can include holes to couple the seat 30 and the strut 36 to the board 20. For example, the board 20 can include a strut hole 11 to accommodate the strut 36 and a plurality of bolt holes 13 (e.g., D-nut holes) to accommodate bolts to mount the seat 30 to the board 20. The strut hole 11 may be, for example, about ⅝ inches wide and about 4 inches long. The board 20 may include four holes with two on each side of the strut hole 11 and two in front and in back of the strut hole 11. The holes are generally in a rear end 28 of the board 20. The board 20 may break during use, and a common location for failure to begin in a board 20 is at the holes and in particular the strut hole 11. A crack often starts at the strut hole 11, heads over to a front bolt hole 13, and out an outer edge of the board 20.

Figure 3:
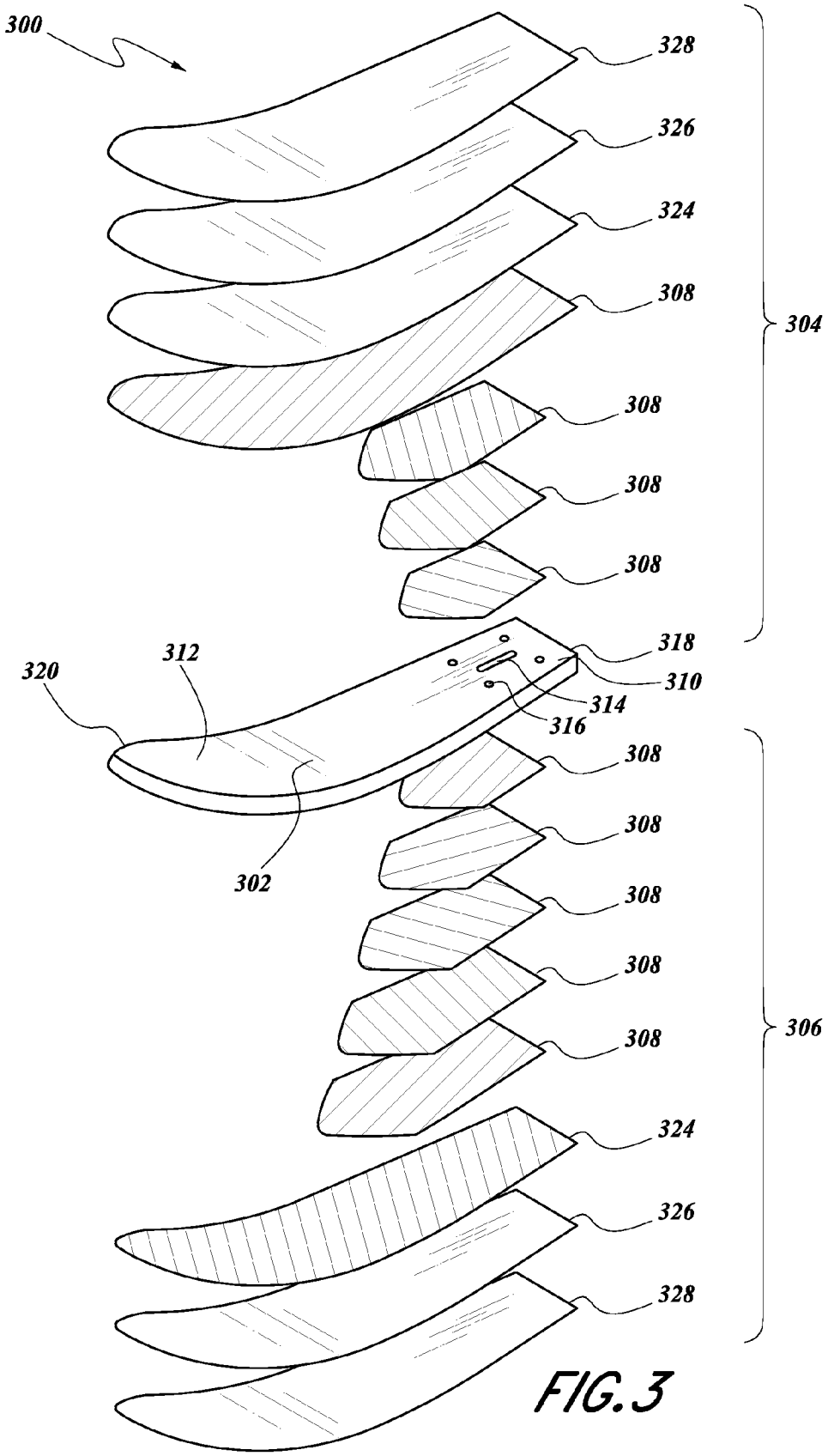
FIG. 3 is an exploded perspective view of a board in accordance with certain embodiments described herein, illustrating layers that can be included in the board.

FIG. 3 is an exploded perspective view of a board 300 in accordance with certain embodiments described herein. The board 300 includes a foam core 302 sandwiched between a plurality of top layers 304 and a plurality of bottom layers 306. The type of layers in the top layers 304 and bottom layers 306 can be similar or may be different in at least one aspect such as number of layers.

The top layers 304 and bottom layers 306 can include one or more fibrous layers 308 (e.g., fibrous patches) that include one or more types of fibers. For example, the fibrous layers 308 can include carbon fibers or glass fibers. The fibers may be substantially unidirectional or uniaxial within each layer. Fibrous layers 308 that are adjacent to one another can have unidirectional fibers that have orientations that are different relative to one another. For example, the fibrous layers 308 can have a fiber direction that is parallel with the board 300, across the board 300, or at other directions relative to the board 300. Mechanical properties can be improved by having the orientation or angle of the fibers in each neighboring fibrous layer 308 be varied. For example, resistance to crack propagation can be reduced. The fibrous layers 308 may also include layers that have crosshatched or bidirectional fibers. FIG. 3 illustrates example orientations of the fibrous layers 308 with direction of hatchings.

To improve failure resistance, the number of fibrous layers 308 can be increased. However, the weight of the board 300 increases as the number of fibrous layers 308 is increased, and as a result, the performance of the flying ski can be reduced. Since the source of failure generally originates at the rear end 310 of the board 300 where the strut hole 314 and bolt holes 316 are located, the rear end 310 can include more fibrous layers 308 than the front end 312 of the board 300. For example, the rear end 310 may include about 24 fibrous layers 308 while the front end 312 may include about six fibrous layers 308. In certain embodiments, the ratio of the fibrous layers 308 in the rear end 310 to the fibrous layer 308 in the front end 312 can be about 4:1 to about 100:1. Furthermore, the ratio of the fibrous layers 308 in the rear one-third of the board 300 to the fibrous layers 308 in the front two-thirds of the board 300 may be about 4:1 to about 100:1. The number of fibrous layers 308 in the top layers 304 may also be different than the number of fibrous layers 308 in the bottom layers 306.

Each of the fibrous layers 308 can extend from approximately the back edge 318 of the board 300 to a position between the front edge 320 of the board 300 and the back edge of the board 300. Each of the fibrous layers 308 may extend at least beyond the holes 314, 316 to improve structural strength around the holes 314, 316. The mechanical properties of the board 300 can be further improved by having the fibrous layers 308 extend to different positions between the front edge 318 of the board 300 and the holes 314, 316. For example, the fibrous layers 308 can have an adjacent or neighboring fibrous layer 308 that is longer and another adjacent or neighboring fibrous layer 308 that is shorter (e.g., a first fibrous layer 308 may be sandwiched between a second fibrous layer 308 that is longer a third fibrous layer 308 that is shorter than the first fibrous layer 308). In other words, the fibrous layers 308 can each be longer than the one before it as fibrous layers 308 progress out from the foam core 302. For example, each fibrous layer 308 can be about 1 to about 1.5 inches longer than the one before it. The fibrous layer 308 furthest from the foam core 302 can extend the entire length of the board 300 from the back edge 318 to the front edge 320 of the board 300 to provide some strength to the front end 312. Furthermore, the front end 312 may only include a single fibrous layer 308. The fibrous layer 308 that extends the entire length of the board 300 may have a fiber direction parallel with the length of the board 300. In addition, each of the fibrous layers 308 can have a front edge 322 with a v-shape or a curvature. A board 300 with fibrous layers 308 with v-shape front edges 322 can have further improved failure resistance compared front edges 322 that are straight across the board 300.

The board 300 can result in significantly less weight compared to certain typical boards. Certain typical boards can weight around about 10 to about 14 lbs and have a balance point (e.g., center of mass) in the center of the board, so the front of the board weighs as much as the back of the ski. By minimizing the fibrous layers 308 in the front end 312 of the board 300, the weight can be reduced to about 6 lbs, and the board 300 can have a center of mass closer to the back end 301 than the front end 312. The performance of the flying ski is increased even further than merely due to the weight reduction. The flying ski rotates by the planing blade 38, shown in FIGS. 1 and 2. Since the board 20 extends out from the strut 36, the front end 26 of the board 20 acts as cantilever weight. Therefore, by reducing the weight at the front end 312 of the board 300, the flying ski can be significantly easier for the rider to maneuver.

The board 300 can be about 54 inches long and all but about 12 inches of the board 300 extends out in front of the seat. However, the back about 12 inches of the board 300 tends to be where the board 300 brakes or fails. Therefore, about 42 inches or about two-thirds of the board 300 extends out front that acts as cantilevered weight. By minimizing the weight on the front ⅔ of the board 300 by minimizing the number of fibrous layers 308 on the front end 312, the front ⅔ may weight about ⅓ of the total weight of the board 300 and the back ⅓ may weight about ⅔ of the total weight of the board 300. For example, the back ⅓ may weight about 4 pounds while the front ⅔ may weight about 2 pounds.

As described above, the board 300 may have a generally bullet shape such that the front end 312 may be wider than the back end 301 of the board 300. When the front end 312 is wider than the back end 301, the front end 312 may weigh even more than the back end 301 if all of the fibrous layers 308 extend the entire length of the board 300. In particular, the front end 312 may have a front surface area and the back end 301 has a back surface area less than the front surface area. For example, the front ⅔ of the board 300 may be about 12 inches wide (except for the front tip) while the back ⅓ of the board 300 may be about 6 to about 8 inches wide. The result can be the front ⅔ of the board 300 has a surface area of at least about three times a surface area of the back ⅓ of the board 300. However, by minimizing the number of fibrous layers 308 that extend to the front end 312 of the board 300 as described herein, the weight of the front end 312 can be less than the back end 310 even when the front end 312 is wider (e.g., has a greater surface area) than the back end 310.

Furthermore, the front end 312 can have a front mass per square inch surface area and the back end 301 can have a back mass per square inch surface area less than the front mass per square inch surface area. For example, the front mass per square inch surface area may be at least three times less than the back mass per square inch surface area. Furthermore, the mass per square inch surface area of the front ⅔ of the board 300 may be at least three times less than the mass per square inch surface area of the back ⅓ of the board 300.

The fibrous layers 308 can be sandwiched between additional layers and the foam core 302. The additional layers can include a barrier paper 324 adjacent the fibrous layers 308. The barrier paper 324 can block sun rays from the carbon fiber to prevent degradation of the carbon fiber. A nexus layer 326 can be sandwiched between the barrier paper 324 and graphics 328. The nexus layer 326 can act as an impact absorber and can also improve adhesion of the graphics 328 compared to the barrier paper 324. The barrier paper 324 also helps eliminate texture on the surface of the board 300 as a result of the texture of the fibrous layers 308 as well as covers the black color of the carbon fiber. The barrier paper 324 can be white which can improve the appearance of the graphics 328.

Figure 4:
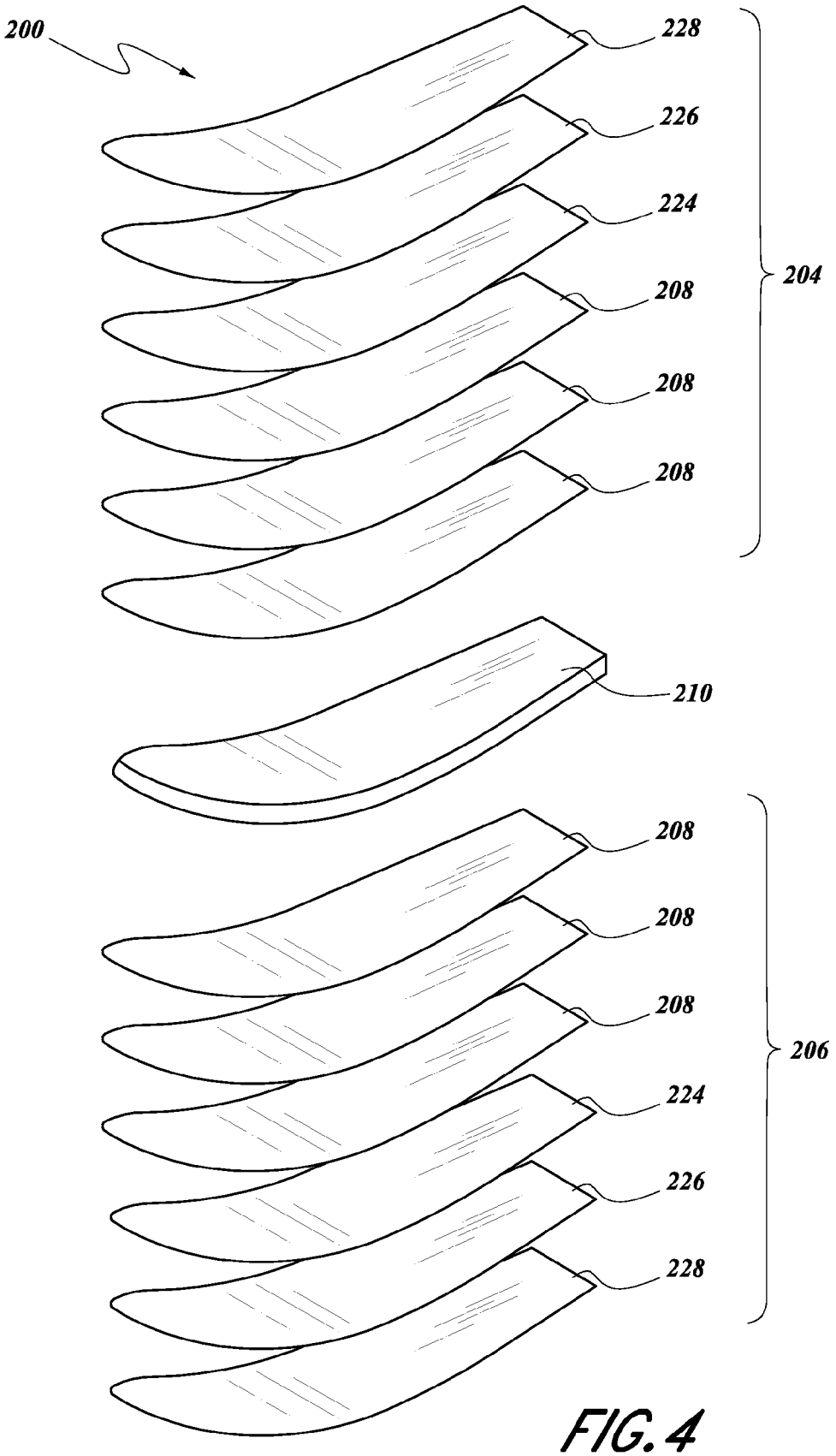
FIG. 4 is an exploded perspective view of a board illustrating layers that may be included in certain boards.

Certain boards typically have a plurality of fiber glass layers with each extending the entire length of the board. FIG. 4 is an exploded perspective view of an example board 200 illustrating layers that may be included to show some of the differences from the board 300 illustrated in FIG. 3. In particular, the board 200 in FIG. 4 includes a plurality of fiber glass layers 408 with each fiber glass layer extending the entire length of the board 400. As discussed above, by having the fiber glass layers extend all the way from the back to the front of the board 400, the front of the board 400 may weigh as much as or more than the back of the board which can negatively impact the performance of the ski.

Certain typical methods of making broads includes fiberglass wrapped around a foam core. The strut holes and bolt holes are drilled or routed out after the fiberglass has been applied to the foam core. The foam core is then exposed on the inside of the holes. As discussed above, the holes are often the location of failure of the board. Described below is an improved hole structure that can improve failure resistance around the holes.

Figure 5A:
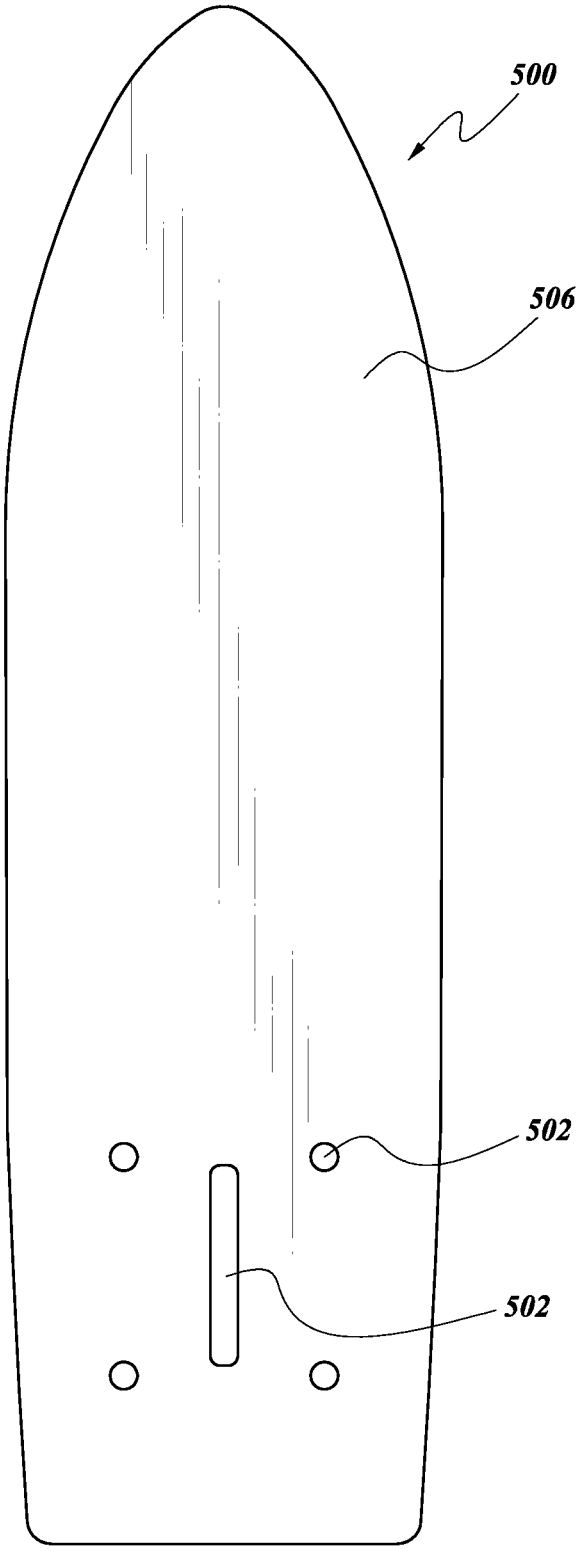
FIG. 5A is a top view of a board with preliminary strut hole and bolt holes in accordance with certain embodiments described herein.

FIG. 5A illustrate a top view of an example board 500 and FIGS. 5B-5F illustrate partial top views of the board 500 at various stages of formation of an improved hole structure. Referring to FIG. 5A, preliminary holes 502 can be formed in the foam core 506 that extend from a top surface to a bottom surface of the foam core 506 prior to the layers being applied thereto. For example, about ¾ inch diameter holes can be made for the four bolt holes and an about 4 by about ⅝ inch hole can be made for the strut hole. As compared to the strut hole sizes described above, the preliminary hole 502 is made to have about an extra ¼ inch all around the hole. Therefore, the preliminary hole 502 is about ½ inch wider and about ½ inch longer. In certain embodiments, a preliminary hole 502 is made to be about ⅛ inch to about ½ inch extra all around the hole compared to the desired final hole size. Alternatively, the preliminary hole 502 can be made to be about ¼ to about ¾ inch wider and longer compared to the desired final hole size.

Figure 5B:
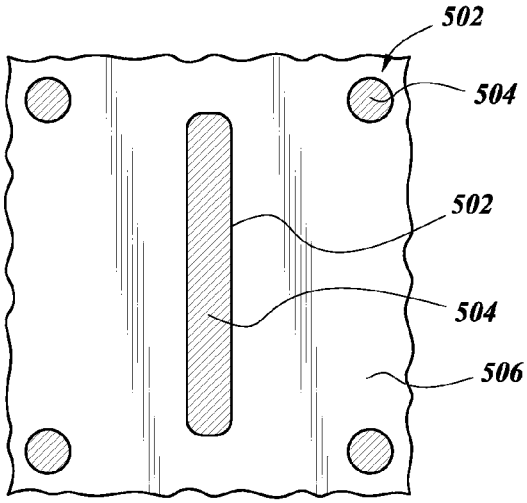
FIG. 5B is a magnified portion of the preliminary strut hole and bolt holes of the board of FIG. 5A with the preliminary holes at least partially filled with a resin.
Figure 5C:
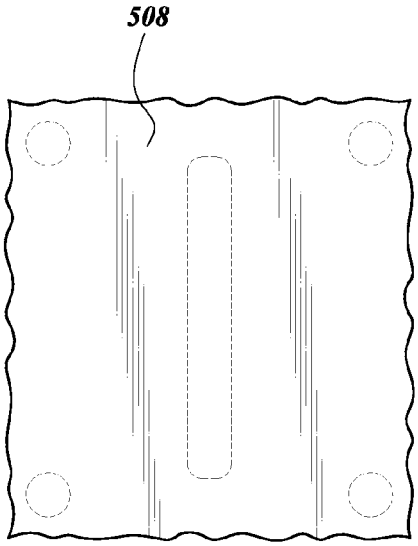
FIG. 5C is the magnified portion of the board of FIG. 5B with a fibrous layer applied to the top of the board (the dashed lines illustrating the preliminary holes underneath the fibrous layer)

Referring to FIG. 5B, the preliminary holes 502 that were formed in the foam core can be at least partially filled with fibers and a resin 504. The resin can include a slow reacting catalyst so that there is additional time to apply the fibrous layers before the resin cures. The fibers can be, for example, carbon fibers. A second resin is than applied to the foam core 506 and the fibrous layers 508 are applied, as illustrated in FIG. 5C. FIG. 5C has the preliminary holes illustrated with dashed lines to illustrate that the fibrous layer 508 is applied on top of the holes 502 and the foam core 506. The second resin can include a faster catalyst than the resin used to fill the holes 502 in the foam core 506. After applying the fibrous layers 508, the barrier paper is applied to the fibrous layers, the nexus layer applied is to the barrier paper, and the graphics are applied nexus layer. Layers can be applied to a first side (e.g., top side), the board can be turned over, and layers can be applied to a second side (e.g., bottom side) of the board. The layers on the bottom side of the board can wrap up the side of the board which provides additional strength of the board. The assembled layers are then placed into a mold for compression molding. After compression molding is complete, the board is removed from the mold and flashing can be trimmed.

Figure 5D:
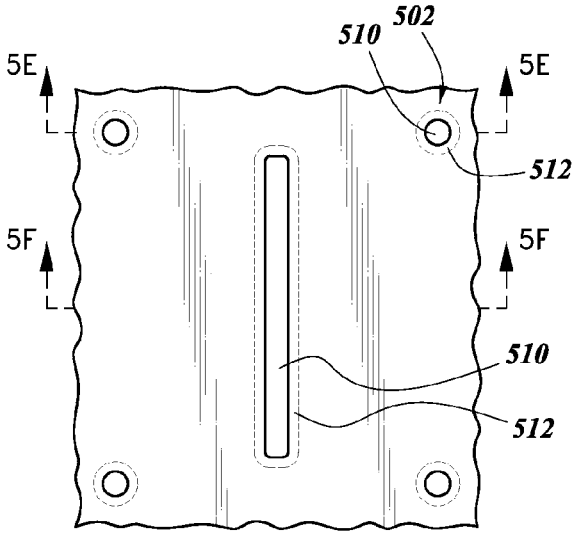
FIG. 5D is the magnified portion of the board of FIG. 5C with final holes formed through the fibrous layer and the resin in the preliminary holes to form final holes reinforced by the resin.
Figure 5E:
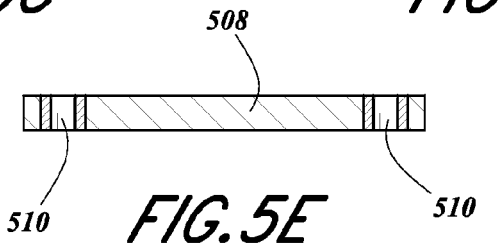
FIG. 5E is a first cross-sectional view of the board of FIG. 5D.
Figure 5F:
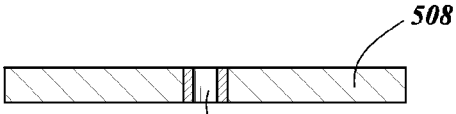
FIG. 5F is a second cross-sectional view of the board of FIG. 5D.

Referring to FIGS. 5D-5F, the final holes 510 for the strut hole and bolt holes can then be routed out using, for example, a CNC router. The final holes 510 are formed through the fibers and solid resin 512 in the holes 502 such that at least some the fibers and solid resin 512 remains that is adjacent the foam core 506. For example, the strut hole can have an about ¼ inch thick solid resin layer all the way around the inside of the hole. An about 5/16 inch hole can, for example, be drill through the resin in the bolt holes to similarly have a solid resin layer all the way around the inside of the holes. The resin in the holes 502 can bonded or set up together with the resin applied to the rest of the foam core 506 to form a unitized structure (e.g., single piece structure or continuous structure). The solid resin 512 provides strength to the final holes 510 and can at like trusses. With boards that have an exposed foam core in the bolt holes, when the bolts are tightened, the bolts may crush the foam core if over tightened. The solid resin 512 can help prevent the foam core 506 from crushing as a result of over tightening the bolts.

Although boards for flying skis have been described in terms of certain preferred embodiments and suggested possible modifications thereto, other embodiments and modifications apparent to those of ordinary skill in the art are also within the scope of the boards described. It is also understood that various aspects of one or several embodiments or components can be used in connection with another or several embodiments or components. Accordingly, the scope of the boards and skis is intended to be defined only by the claims that follow.

What is claimed is:

1. An elongated board configured for use with a recreational device that supports a seated human rider while the rider and the device are towed behind a powered watercraft, comprising:

a front end and a back end, the front end extending from a front edge to about one-half of the length of the elongated board and the back end extending from a back edge to about one-half of the length of the elongated board, wherein the back end has a greater mass than the front end; and an opening in the back end configured to couple with a seat portion extending upward from a top side of the back end of the board and a strut extending downward from a bottom side of the back end of the board;

a foam core with a plurality of fibrous layers on a top and a bottom surface of the foam core, wherein the plurality of fibrous lay ers comprise more than one fibrous layer on a least one of the to and the bottom surfaces of the foam core, the fibrous layers on the at least one of the top and the bottom surfaces of the foam core comprises a first fibrous layer that extends from a front edge to a back edge of the foam core and a second fibrous layer sandwiched between the first fibrous layer and the foam core, the second fibrous layer extending from the back edge toward the front edge of the foam core to a first position before the front edge of the foam core.

2. The elongated board of claim 1, wherein the first position is located from the front edge a distance of at least one-third the length of the foam core.

3. The elongated board of claim 2, wherein the distance from the front edge is less than two-thirds the length of the foam core.

4. The elongated board of claim 1, wherein the first position is located from the front edge a distance of at least one-half the length of the foam core.

5. The elongated board of claim 1, wherein the plurality of fibrous layers comprises a third fibrous layer sandwiched between second fibrous layer and the first fibrous layer.

6. The elongated board of claim 5, wherein the third fibrous layer extends from the back edge toward the front edge to a second position between the front edge and the first position.

7. The elongated board of claim 6, wherein the second position is located from the front edge a distance of at least one-half the length of the foam core.

* * * * *

UNITED STATES PATENT AND TRADEMARK OFFICE

CERTIFICATE OF CORRECTION

PATENT NO. : 8,979,604 B1
APPLICATION NO. : 13/335573
DATED : March 17, 2015
INVENTOR(S) : Robert C. Woolley It is certified that error appears in the above-identified patent and that said Letters Patent is hereby corrected as shown below:

Claims

In column 7 at line 10, In Claim 1, change “lay ers” to --layers--.

In column 7 at line 11, In Claim 1, change “to” to --top--.

Signed and Sealed this
Nineteenth Day of January, 2016

Michelle K. Lee

Michelle K. Lee
*Director of the United States Patent and Trademark Office*